US006186688B1

(12) United States Patent
Davis

(10) Patent No.: US 6,186,688 B1
(45) Date of Patent: Feb. 13, 2001

(54) DISPOSABLE MAGNETIC FINGERPRINT BRUSH

(76) Inventor: James Ray Davis, 24701 Lakeview Dr., Spicewood, TX (US) 78669

( * ) Notice: Under 35 U.S.C. 154(b), the term of this patent shall be extended for 0 days.

(21) Appl. No.: 09/480,230

(22) Filed: Jan. 10, 2000

Related U.S. Application Data

(60) Provisional application No. 60/121,598, filed on Feb. 25, 1999.

(51) Int. Cl.[7] ..... A46B 11/00
(52) U.S. Cl. ..... 401/118; 118/31.5; 427/1
(58) Field of Search ..... 401/13, 118, 129, 401/191, 292; 427/1; 118/31.5; 15/1.52

(56) References Cited

U.S. PATENT DOCUMENTS 4,214,874 * 7/1980 White ..... 73/864.01
4,381,159 * 4/1983 Payne ..... 401/118

* cited by examiner

*Primary Examiner*—Henry J. Recla
*Assistant Examiner*—Peter deVore

(57) ABSTRACT

A Magnetic, latent fingerprint development brush featuring a non-rigid, removable, disposable cover/body, to be used when developing latent fingerprints on contaminated surfaces. The cover can be removed and cleaned or disposed of and exchanged with a new cover. The non-rigid design allows operation without tension springs. The tip is less abrasive against surfaces being printed, since it has no sharp rigid edges. This lessens the chance of distortion of the latent print. The design is simple. A magnetic rod is attached to a handle, which is inserted into a flexible removable cover/body. A light grip holds the cover against the handle during use.

1 Claim, 5 Drawing Sheets

DISPOSABLE MAGNETIC FINGERPRINT BRUSH

This application claims benefit of Provisional application Ser. No. 60/121,598 filed Feb. 25, 1999.

CROSS REFERENCE TO RELATED APPLICATIONS

The Disposable Magnetic Fingerprint Brush references U.S. Pat. 4,381,159 in the general concept of using a magnet to distribute ferrous fingerprint powder when dusting for latent fingerprints on non-metal surfaces.

BACKGROUND OF THE INVENTION

This application pertains to the field of Law Enforcement and is a device for developing latent fingerprints on a variety of non-metal surfaces. Information on the technique used in "dusting"for latent prints can be found in the book, The Science of Fingerprints 1977 issue (F.B.I./ Dept. of Justice) chapter 14. A magnetic brush allows even distribution of ferrous fingerprint powder and ease in clean up from the surface being dusted, which is conducive to better quality prints. Problems involved in the prior use of magnetic fingerprint brushes are; 1) Sterilizing the brush after biohazard crime scenes, without causing damage to the brush. (submersing the entire brush can lead to mechanical failure) 2) Rigid materials used in construction of prior magnetic brushes caused distortion of latent prints. Anytime the brush came in contact with the surface being printed, a scratch could be detected. 3) Prior designs can't be operated upside down without the use of an internal tension spring. 4) When the tension spring gets jammed or breaks, the magnetic brush won't work.

BRIEF SUMMARY OF THE INVENTION

The general idea of the Disposable Magnetic Fingerprint Brush is to provide Law Enforcement personnel with a simple device for developing latent prints with the advantage of a removable, disposable cover. Other surprise advantages were realized when a non-rigid plastic material was used as the disposable cover. A light grip against the outer cover holds the magnet engaged and allows operation in any position, without internal tension springs. The flexible outer cover is less abrasive when inadvertent contact is made between the brush and the surface being dusted, which lessens distortion of the latent print.

BRIEF DESCRIPTION OF THE SEVERAL VIEWS OF THE DRAWING

This Disposable Magnetic Fingerprint Brush, FIG. 1 employs the use of a modified polyethylene transfer Pipet as a disposable cover for a magnet tipped plastic piston, which is used to pick up and spread ferrous fingerprint powder from a separate reservoir onto non-metal surfaces.

The brush consists of only four components.

1) A magnetic rod. (reusable)

2) A tubular plastic piston. (reusable)

3) A polyethylene cover/body. (disposable)

4) A tip shield. (disposable)

Figure 3:
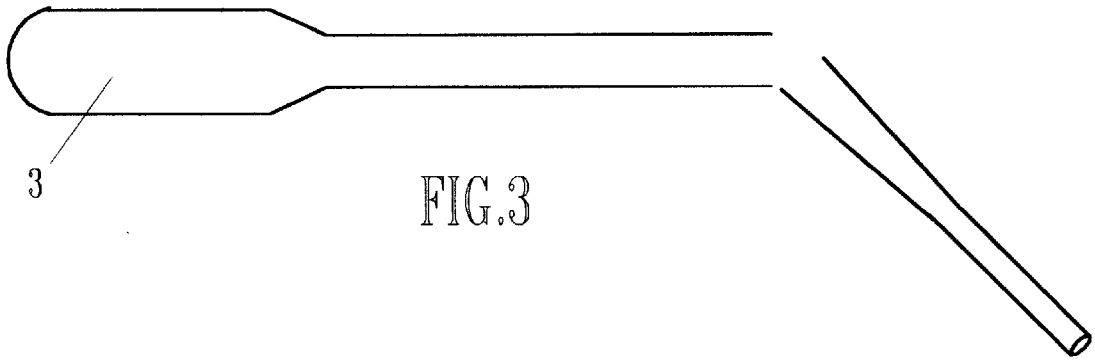

These four components are assembled as follows;

FIG. 3 Remove and discard the tapered end of Transfer Pipet 3. The remainder will be used as cover/body 3.

Figure 4:
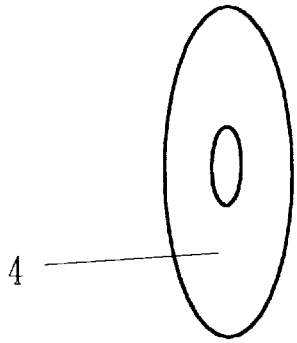

FIG. 4 The shield 4 is a disc shaped piece of plastic sheeting with a center hole.

Figure 5:
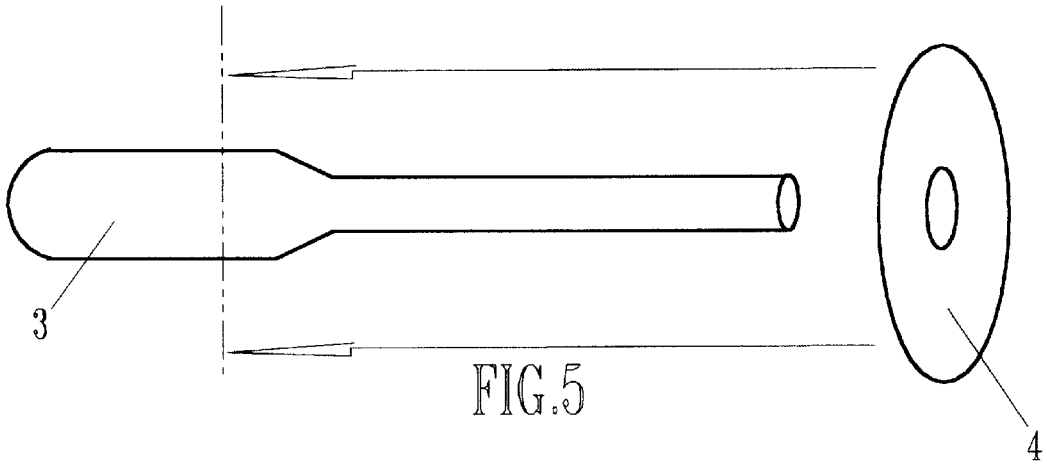

FIG. 5 The cut end cover/body 3 is placed through the hole in shield 4 until the bulb portion of cover/body 3 contacts the shield 4. The shield 4 is then stretched over the bulb and positioned near the center of the bulb, forming assembly 3-4, FIG. 6

Figure 7:
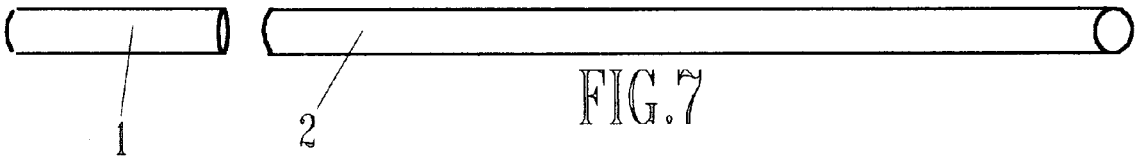
Figure 8:
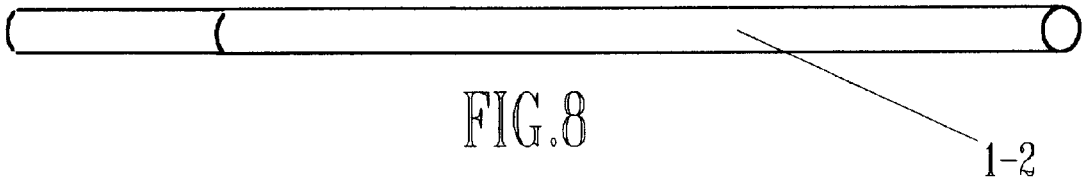

FIG. 7 The magnetic rod 1 and the tubular plastic piston 2 are aligned end to end and then permanently joined together with tape, forming assembly 1-2, FIG. 8

Figure 9:
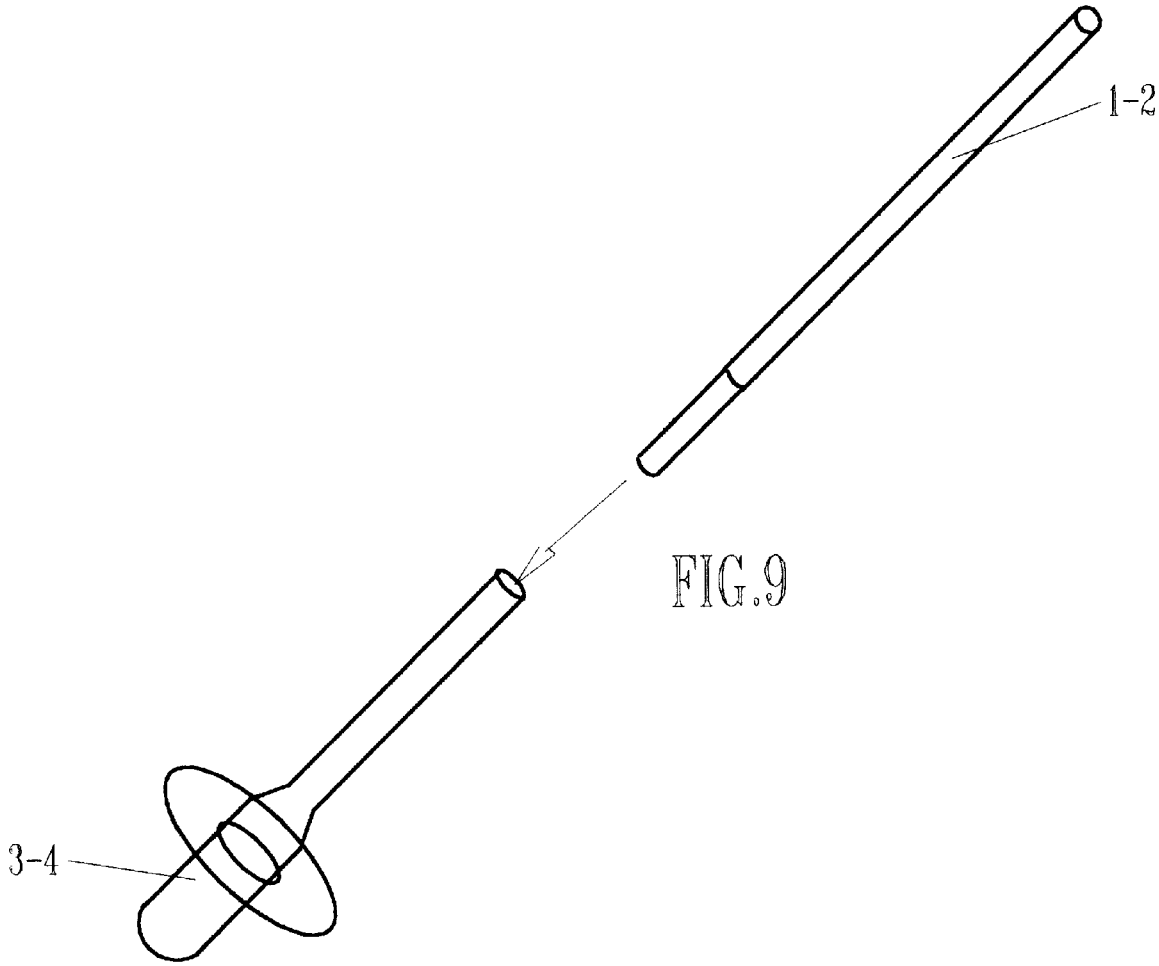

FIG. 9 Assembly 1-2 is inserted magnet first into the open end of assembly 3-4

DETAILED DESCRIPTION OF THE INVENTION

The Disposable Magnetic Fingerprint Brush is an improvement over prior magnetic fingerprint brush designs. This new design offers a removable, disposable outer cover/body. Because this cover/body is made of lightweight, non-rigid polyethylene plastic, a normal grip holds the cover and internal magnetic rod together in operation. This new design can be operated in any position without the need for internal spring tension. The smooth outer cover/body design also reduces distortion of latent prints. Prior designs had rigid sharp edges exposed on the exterior of magnetic brushes. These edges could scratch across surfaces being printed and cause scratch lines visible in the latent fingerprint. The lightweight design allows the brush tip to be cushioned from the surfaces and float across the surfaces atop a globe of ferrous fingerprint powder attracted to the tip.

Figure 1:
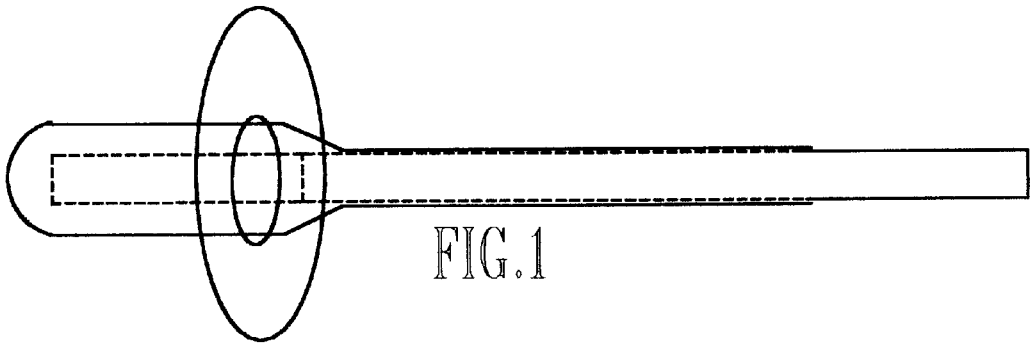
Figure 2:
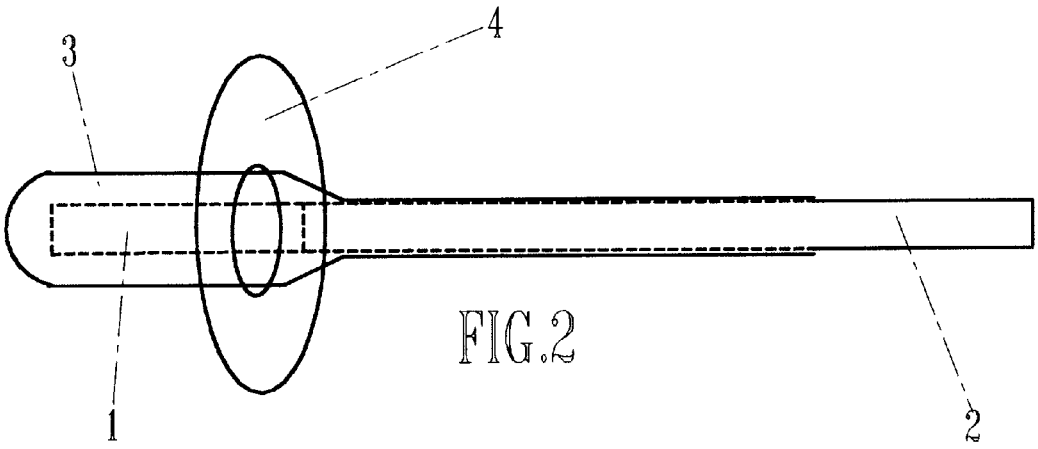
FIG 2

The design is very simple. A magnet attached to a stem is inserted into a disposable cover to form a complete magnetic fingerprint brush. FIG. 1 There are only four components to be assembled; 1) magnet, 2) tubular piston, 3) polyethylene cover/body, 4) tip shield FIG. 2

Figure 6:
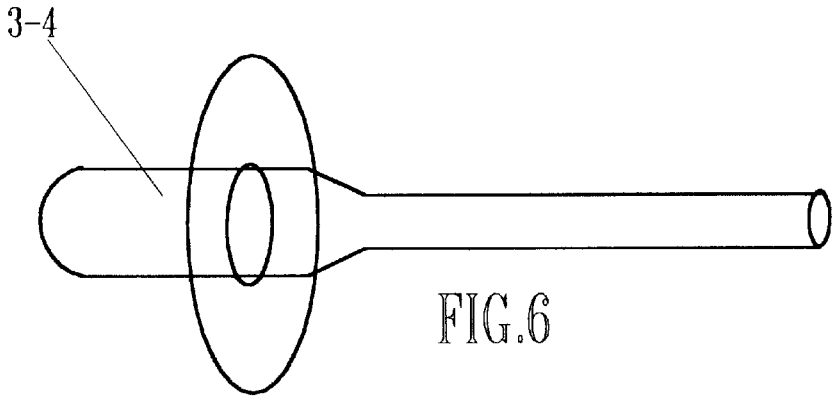

The outer cover FIG. 3 is a modified Polyethylene Transfer Pipet (jumbo size; 3.5 ml. bulb draw, 6" long) The tapered end of the stem of the Pipet is severed and discarded leaving the remaining Pipet to be used as the cover/body. The cover/body now measures 4" overall length and is hollow. A disc shaped washer FIG. 4 made of 6 ml plastic sheeting, 1.75" Diameter with a 0.38" center hole, is fitted down the stem and stretched onto the bulb portion of the Pipet FIG. 5 to form a flexible powder shield. FIG. 6 The magnet (1"×0.25" rod ) is aligned end to end with a plexi-glass tubular piston (4"×0.25") FIG. 7, and then taped together to form a handle. FIG. 8 The handle is fitted magnet first into the open end of the cover/body FIG. 9 until the magnet is against the inside of the bulb (tip) of the cover/body. The handle protrudes one inch from the end of the cover/body. This forms a completely assembled unit. FIG. 1

The brush is operated by gripping the brush as you would hold a pencil, keeping the bulb portion pointed downward. Dip the bulb into a separate reservoir of ferrous powder until it collects a starburst globe of powder on the tip of the bulb. Lightly drag this globe of powder across non-metal, searchable surfaces. When the powder crosses residue of oils and moisture left behind on the surface by human skin ridge patterns, a small amount of powder will change to these ridges. The latent fingerprint will be developed into a visible pattern. The unused powder still attracted to the tip of the bulb can be disposed of if it becomes contaminated, or may be saved and reused. To release the powder back into the reservoir, hold the tip of the brush above the open reservoir and then withdraw the magnet from the bulb by pulling on the protruded handle. The powder will release when the magnet moves past the shield.

What I claim as my invention is a disposable magnetic fingerprint brush comprising:

1. A disposable magnetic fingerprint brush for attracting and distributing ferrous fingerprint powder, said brush comprising a magnet/piston assembly and a removable protective cover/shield having a tip, said protective cover/shield constructed of thin flexible plastic and fitted over said magnet/piston assembly, said protective cover/shield adapted to compress inward against said magnet/piston assembly when gripped, said magnet/piston assembly adapted to be engaged in various positions within said protective cover/shield in order to control the amount of ferrous fingerprint powder to be attracted to the tip of said protective cover/shield.

* * * * *